United States Patent [19]

Combette et al.

[11] 4,210,267

[45] Jul. 1, 1980

[54] REAR-LOADING POWDER-ACETUATED TOOL

[75] Inventors: Marc Combette; Jean Ollivier, both of Valence, France

[73] Assignee: Societe de Prospection et d'Inventions Techniques, S.P.I.T., Bourg-les-Valence, France

[21] Appl. No.: 943,021

[22] Filed: Sep. 18, 1978

[30] Foreign Application Priority Data

Nov. 23, 1977 [FR] France ..... 77 35264

[51] Int. Cl.[2] ..... B25C 1/14

[52] U.S. Cl. ..... 227/10; 227/8

[58] Field of Search ..... 60/632, 633, 634, 635, 60/637, 638; 227/8, 9, 10, 11

[56] References Cited

U.S. PATENT DOCUMENTS

| | | | |
|---|---|---|---|
| 2,930,042 | 3/1960 | Temple et al. | 227/10 |
| 2,936,455 | 5/1960 | Temple et al. | 227/10 |
| 2,970,314 | 2/1961 | Temple et al. | 227/10 |
| 3,172,119 | 3/1965 | Siddons | 227/10 |
| 3,357,617 | 12/1967 | Osborne | 227/10 |
| 3,409,197 | 11/1968 | Brack | 227/10 |
| 3,471,074 | 10/1969 | Rosselet | 227/10 |

FOREIGN PATENT DOCUMENTS

| | | | |
|---|---|---|---|
| 1469786 | 2/1967 | France | 227/10 |
| 1531056 | 6/1968 | France | 227/10 |
| 1581949 | 9/1969 | France | 227/10 |

*Primary Examiner*—Paul A. Bell

*Attorney, Agent, or Firm*—William W. Jones; Paul J. Lerner

[57] ABSTRACT

A fastener driving apparatus having a barrel provided with a fastening element guide which is pivotally mounted about an axis orthogonal to the barrel axis in order to introduce a fastening element therein.

The fastening element guide is pivotally mounted on a support secured to the barrel, and there is provided a sleeve operative to engage the guide and pivot the same, said sleeve being moveably carried on the support for translation along the barrel axis in such manner that a relative sliding movement between the sleeve and support, causes the engagement of the sleeve and the guide for pivoting of the latter.

2 Claims, 4 Drawing Figures

REAR-LOADING POWDER-ACETUATED TOOL

BACKGROUND OF THE INVENTION

The present invention relates to an apparatus for driving fastening elements and, in particular, to a fastener driving apparatus with a hammer piston.

In many known apparatuses of this type, the loading of the fastening elements is carried out through the mouth of the apparatus, which displays disadvantages which manufacturers intend presently to eliminate.

Whether it concerns nails or other fastening elements, for instance self-boring fasteners, the forward end of the fastener is in the shape of a point upon which the operator must push in order to introduce, or load, the elements into these apparatuses, this entailing the risk of injury. Of course, by using a specialized tool for this loading operation, the risk of injury is eliminated, but this creates a new disadvantage which is the necessity of having such a tool immediately available.

Further, in the case where the fastening element is loaded through the muzzle, or front part, of an apparatus with such a specialized tool, the foreward end of the fastening element is in contact with the material intended to receive it, prior to impact on the element by the hammer piston, so that the penetration of the fastener into the material begins at a very low speed, which is detrimental to the quality of the fastening.

Apparatus of the type wherein the fastening elements are loaded through an opening formed in the barrel are known in the art, as, for example, U.S. Pat. Nos. 2,930,042, 2,936,455 and 2,970,314. While the first disadvantage hereabove mentioned is eliminated, such tools suffer in that the opening, when closed for firing, is not filled up and a discontinuity in the guide for the fastening elements arises in this area.

It has been attempted, for example, in U.S. Pat. No. 3,357,617 to reduce the disadvantage of the prior apparatus by the provision of a sliding element which fills up the loading opening during firing. Such tools, however, tend to be very fragile.

Two further approaches have been taken toward solving the above-described problem.

One of them, described in U.S. Pat. No. 3,172,119, comprises fixed means for receiving and guiding a fastening element, propelling means for a driving piece, and a barrel containing the driving piece and pivotally mounted about an axis parallel to the gun in order to be either aligned with the whole assembly of said means, or being moved to a lateral loading position in which the rear part of the fixed receiving and guiding means are accessible for loading the fastening elements.

The other, described in French Pat. No. 2,336,216, comprises a pivoting feeding device used for introducing the fastening elements into the barrel.

With these last two types of apparatus, an operator does not run the risk of injury during loading of the fastening elements, and a fastening element can penetrate the receiving or target material at a sufficient speed. The necessity for the operator to manually pivot the barrel of the feeding device, however, makes the handling of such apparatus particularly delicate and complicated.

Finally, other patents, such as French Pat. Nos. 1,469,786, 1,531,056 and 1,581,949, disclose apparatuses having barrels provided with muzzles for guiding the fastening elements, said barrels being pivotally mounted about axes orthogonal to the gun axis so as to provide access to the rear of the guiding muzzle for introduction of fastening elements therein. Such apparatuses solve the general problem mentioned hereabove. However, the pivoting of their guiding muzzles requires manual intervention which is a handicap to their use.

SUMMARY OF THE INVENTION

The present application relates to a fastener driving apparatus wherein the barrel is provided with a fastening element guide pivotally mounted about an axis orthogonal to the barrel axis in order to introduce the fastening element therein.

The main object of the present invention is to provide pivoting of the fastening element guide through a very simple and easy operation.

To this end, the fastening element guide is pivotally mounted on a support secured to the barrel, and means are provided for engaging the guide and pivoting it, the engaging means being moveable, relative to the support, along the barrel axis, in such manner that a sliding movement of the engaging means, relative to the support, causes the engagement of the engaging means and the guide for pivoting the guide.

A further object of the invention is to cause the pivoting of the fastening element guide without any other additional operation than those usually required for preparing the apparatus for use.

To this end, the barrel of the apparatus is slidably mounted on a barrel-holder, such that opening of the apparatus, and the guide, may be accomplished through a single operation by simply pulling the engaging means towards the front part of the apparatus, causing the engaging means to slide, relative to the support, and, therefore, to the barrel, and further causing the barrel to slide relative to its barrel-holder.

DESCRIPTION OF THE DRAWINGS

The invention will become more apparent from the following description of the preferred embodiment of the invention, when taken in conjunction with the accompanying drawing wherein.

DESCRIPTION OF THE PREFERRED EMBODIMENT

Figure 1:
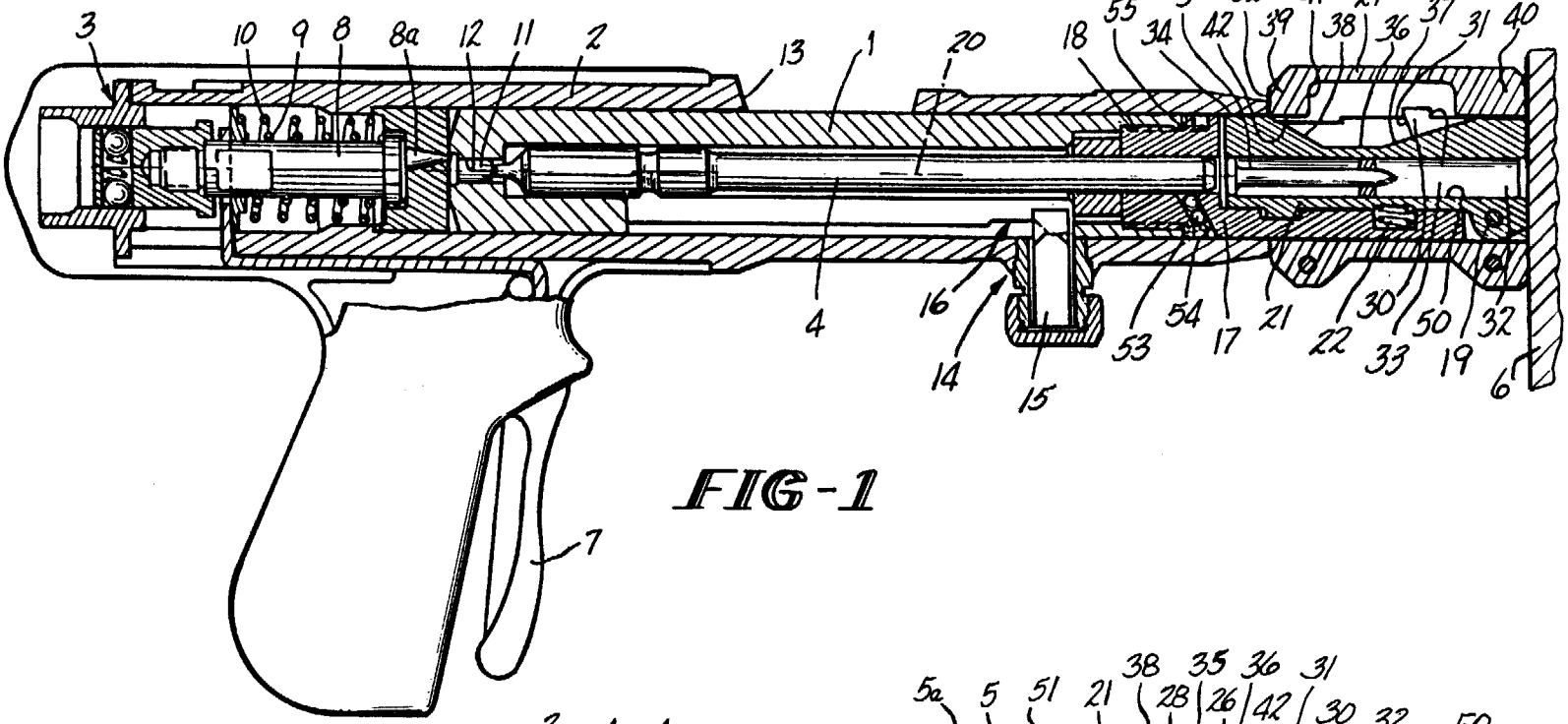
FIG. 1 is an axial cross-sectional view of a fastener driving gun with a hammer piston, according to the invention, in a position for firing.

The apparatus shown in the drawings is a conventional fastener driving gun, with propelling charge, improved according to the invention. It comprises a barrel 1, slidably mounted in a barrel-holder 2, a firing mechanism 3, known per se, and a hammer piston 4 slidably mounted within the barrel 1, for driving a fastening element, or pin, 5 which a material 6 is intended to receive. The gun of FIG. 1 is shown in the firing position, meaning that the trigger 7 of the gun has been actuated, the striker 8, of the firing mechanism 3 has been propelled forwardly by the striker spring 9, the mouth of the apparatus is bearing on the material 6, against the action of the spring 10, and the point 8a of the striker 8 is engaging a cartridge 11 lodged in the combustion chamber 12 provided at the rear end of barrel 1.

An opening 13 is provided in the barrel-holder 2 for loading the cartridges 11 in the combustion chamber 12 of the barrel 1, when the gun is open, i.e., when the barrel 1 has been pulled forwardly, in its barrel-holder 2, in order to make its rear combustion chamber 12 accessible through the loading opening 13.

The gun shown in the drawing is also provided with means 14 for returning the hammer piston, known per se, comprising a return pawl 15 and an associated milled unit 16 on barrel 1. The hammer piston return means are not part of the present invention and, therefore, will not be described further.

The barrel of the fastener driving gun hereinabove described is extended forwardly by a support 17 which is fixedly attached to barrel 1 by conventional means, as for instance via inner and outer threads 18 respectively formed on support 17 and barrel 1, a seal 55 being placed between barrel 1 and support 17.

Figure 2:
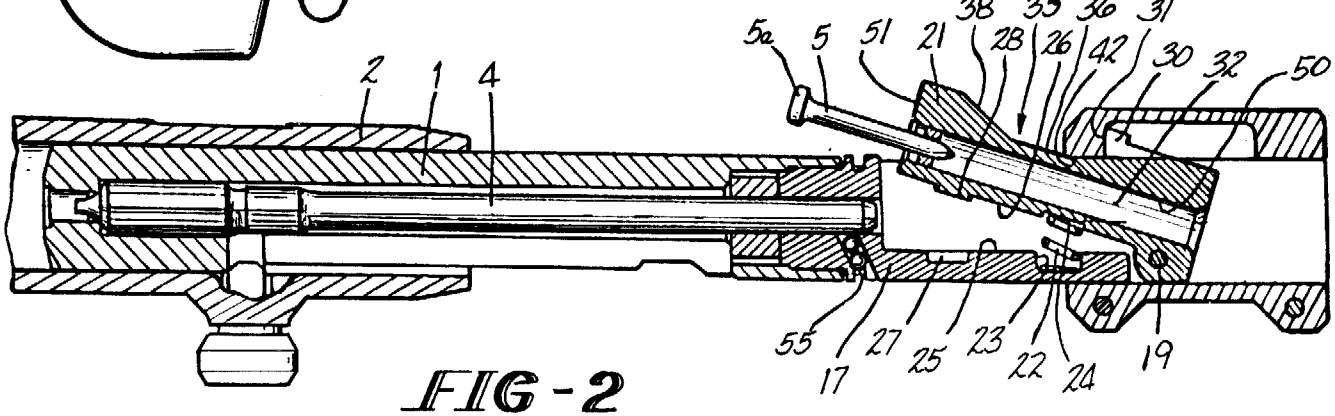
FIG. 2 is a view, similar to FIG. 1, showing the gun in a position for loading a fastening element.

About an axis 19, extending orthogonally to axis 20 of barrel 1 and fixedly secured to the holder 17, is pivotally mounted a receiving and guiding element 21 for a pin 5, formed with a central bore 50 with axis 32 provided for receiving first the pin 5, then for guiding it to the material 6 after firing. As appears more clearly in FIG. 2, a spring 22 bears on the bottoms of two recesses 23 and 24, respectively formed in the opposite faces 25 and 26 of support 17 and guide 21. A further recess 27 is provided in the face 25 of support 17 for receiving a corresponding projection 28 formed on face 26 of guide 21.

The engaging means comprises a sleeve 29 slidably mounted along axis 20 of barrel 1, around the support 17 and the guide 21.

At its upper end, the guide 21 is formed with a stub 30 upon which is provided a ramp 31, inclined toward the rear relative to the axis 32 of guide 21, and a shoulder 33. When the guide 21 is co-axial with barrel 1, the upper wall 34 of guide 21 forms an extension of that of barrel 1 and stump 30 extends beyond the surface of said walls. A groove 35 is also provided at the upper portion of guide 21, formed with a bottom 36 connecting two ramps 37 and 38, respectively inclined towards the front and towards the rear relative to the axis 32 of guide 21.

The sleeve 29 has two end walls 39 and 40 extending radially relative to axis 20 of barrel 1 and provided for engagement with guide 21, the sleeve 29 as such being used essentially as grasping means.

The receiving and guiding element 21, thus described, operates in the following manner.

From the position shown in FIG. 1, the operator causes the sleeve 29 to slide in the forward direction. The inner face 41 of wall 39 engages stub 30 of guide 21, and the sleeve 29 proceeding in its sliding movement on support 17, face 41 engages the inclined ramp 31 of stub 30 of guide 21 to pivot guide 21 about axis 19, assisted in its pivoting movement by spring 22, until ramp 37 of stub 30 of guide 21 comes in abutment against the axial face 42 of wall 39 of sleeve 29 and until the ramp 31 of guide 21 comes in engagement against the inner face 41 of sleeve 29, in a position shown in FIG. 2.

In this position, the rear opening of bore 50 of guide 21 is sufficiently spaced apart from axis 20 of barrel 1 to provide access thereto, and the operator of the apparatus according to the invention may now introduce therein a fastening element 5 by handling the non-pointed rear end 5a of said element. Without running the risk of injury, the operator may precisely position pin 5 in the receiving and guiding element 21, in such manner that the rear face of end 5a of pin 5 is in the plane of the rear face 51 of guide 21.

Once the pin 5 is in position in guide 21, the operator causes sleeve 29 to slide in the reverse direction towards the rear. The axial face 42 of wall 39 of sleeve 29, acting as a cam, then engages, in succession, the bottom 36 and the inclined cam 38 of groove 35 of guide 21, in order to pivot in reverse direction and against the action of spring 22, the guide 21 about the axis 19, until the element 21 resumes its guiding position in support 17, as shown in FIG. 1, with faces 25 and 26 of support 17 and of guide 21 being engaged with one another and the projection 28 of guide 21 being located in its housing 27 in support 17. In this position, the guide 21 is blocked in the support 17 by walls 39, 40 of sleeve 29 whose rear face 52 of wall 39 bears against the forward end of the barrel-holder 2, thus limiting the sliding movement of sleeve 29 towards the rear.

As may also be seen from FIG. 1, the apparatus is now ready for driving pin 5 into the material 6, the forward end of pin 5 being sufficiently remote from the material 6 for reaching it under the action of hammer piston 4 with a sufficient speed favorable for a good fixation.

Balls 53 for retaining hammer piston 4, provided for preventing it from sliding slightly in the forward direction when the apparatus is being handled, are lodged inside a recess 54 in support 17, in which they are maintained by a resilient ring 55.

It is clear that the invention does not apply exclusively to the fastener driving gun which has just been described. It is, of course, advantageous to use it with a gun whose barrel is articulated with the gun body. However, the invention assumes its full importance with the hereinabove described apparatus, where the barrel 1 is slidably mounted in the barrel-holder 2, such that by pulling the sleeve 29 in a forward direction it slides, relative to guide 21, while barrel 1 slides relative to barrel-holder 2, thereby providing, with one single opening movement, the possibility of ejecting, in known manner, a used cartridge 11, of returning the hammer piston 4, and of making the rear portion of guide 21 accessible for introducing a new fastening element 5 therein. It is even possible, with the gun represented, to perform this opening operation single handed, by throwing it at arms length, the sleeve 29 and the barrel 1 sliding respectively on the barrel 1 and in the barrel-holder 2 because of their inertia.

Figure 3:
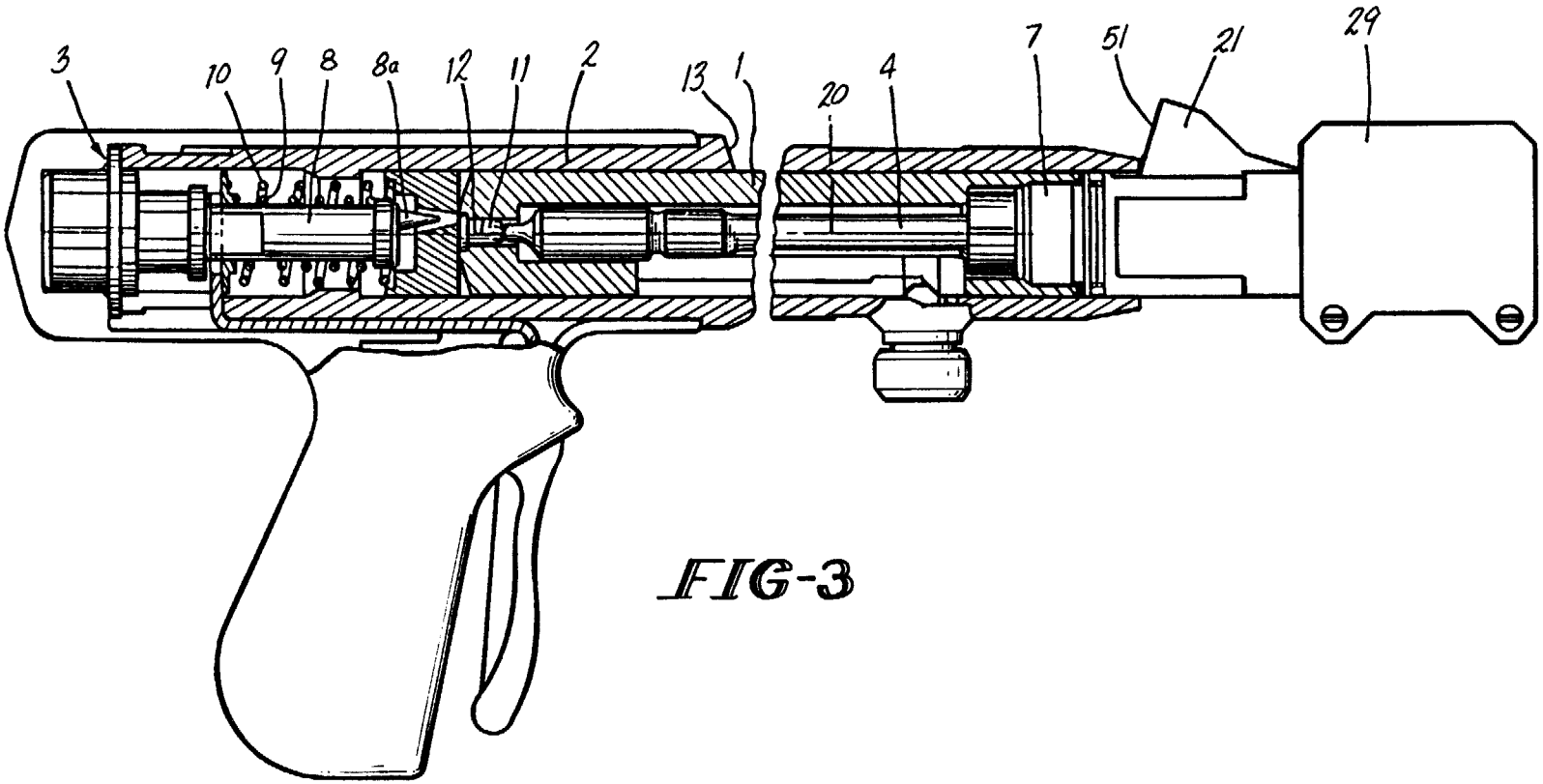
FIG. 3 is a view similar to that of FIGS. 1 and 2, illustrating the safety of the firing operation provided by the guide in the case where its receiving bore is not co-axial with the barrel.

FIG. 3 of the accompanying drawing illustrates the firing safety provided by guide 21 in the case where its receiving and guiding bore 50 for a pin 5 is not co-axial with barrel 1. In such a case, and after a relative sliding movement of barrel 1 and barrel-holder 2, the rear face 51 of guide 21 is abutting against the forward end of barrel-holder 2, preventing barrel 1 from coming back completely rearwardly into its barrel-holder 2, the pin 8a of striker 8 being then prevented from striking the charge 11 lodged in the combustion chamber 12 of barrel 1.

Figure 4:
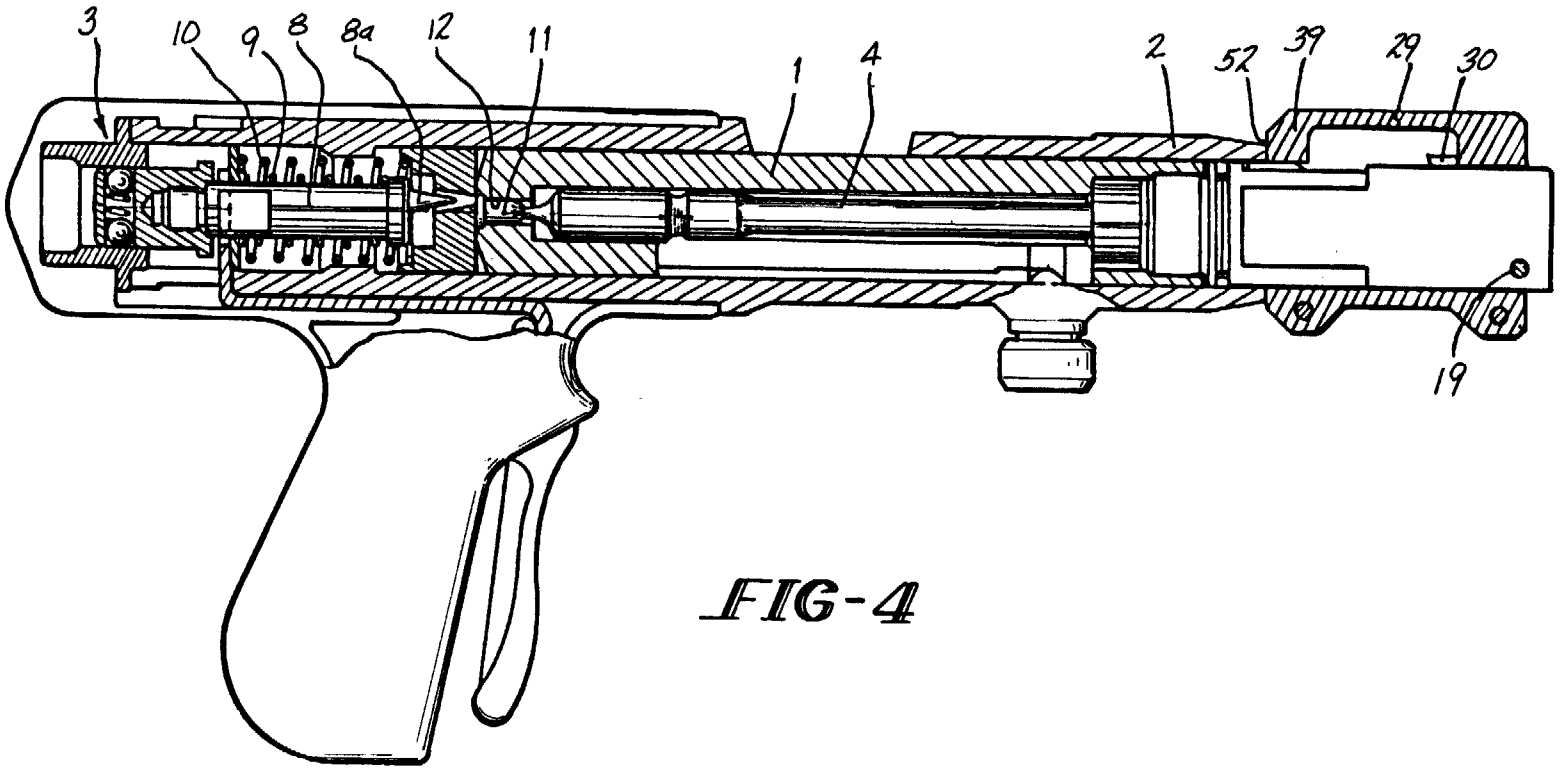
FIG. 4 is a view, similar to that of FIGS. 1-3, illustrating the safety of the firing operation provided by the guide in the case where the mouth of the apparatus is not bearing against the material intended for receiving a fastening element.

Finally, FIG. 4 illustrates the firing safety provided by the device according to the invention, if the apparatus is not bearing against the material intended to receive the fastening element. As is the case in this figure, sleeve 29, engaged against barrel-holder 2, cannot draw barrel 1 sufficiently towards the rear, so that its rear end, and, therefore, the combustion chamber 12, is positioned slightly forward relative to its firing position in which the pin 8a of striker 8 could effectively strike the cartridge 5.

A fastener driving gun with propelling charge has been described, but it will be understood that the invention applies also to other apparatuses, be they electrically, pneumatically or hydraulically actuated. Moreover, the invention is not limited to a pure translation drive of the fastening element, it being possible that the latter be also rotatively driven about its axis.

We claim:

1. A fastener driving apparatus comprising a barrel-holder, a barrel slidably carried in said holder, a support fixedly carried on a distal end of said barrel, a fastener guide pivotally mounted, proximate one end thereof, on said support, said guide being pivotable between a first position concentric with said barrel and a second position eccentric with said barrel, sleeve means, slidably carried on said support and moveable, relative to said guide, along the barrel axis, said sleeve co-acting with said guide to displace the latter from one to the other of said positions pursuant to an axial displacement of the former, and spring means biasing a distal end of said guide away from the barrel axis.

2. An apparatus for driving fastening elements, of the type including a barrel and a moveable piece in the barrel for driving a fastening element, the barrel being provided with a fastening element guide pivotally mounted about an axis orthogonal to the barrel axis in order to introduce the fastening element therein; the improvement comprising; a support secured to the barrel, said guide being pivotally mounted on said support, and means for engaging and pivoting said guide, said means being adapted for translation, along the barrel axis, relative to said support, in such manner that the relative sliding movement of said means and said support causes the engagement of said means and said guide for pivoting the latter, the guide end nearer the rear of the apparatus being biased away from the barrel axis by resilient means.

* * * * *